US005586456A

United States Patent [19]

Takagawa et al.

[11] Patent Number: 5,586,456

[45] Date of Patent: Dec. 24, 1996

[54] APPARATUS FOR WASHING AND DRYING CLOTHES

[75] Inventors: Hiroyuki Takagawa; Yasuhiro Tsubaki; Yoshio Miyairi; Toshio Hattori; Haruo Hagiwara, all of Nagoya, Japan

[73] Assignee: Mitsubishi Jukogyo Kabushiki Kaisha, Tokyo, Japan

[21] Appl. No.: 530,447

[22] Filed: Sep. 19, 1995

Related U.S. Application Data

[62] Division of Ser. No. 257,295, Jun. 9, 1994, Pat. No. 5,498, 266.

[30] Foreign Application Priority Data

| | | | |
|---|---|---|---|
| Jun. 11, 1993 | [JP] | Japan | 5-164985 |
| Oct. 28, 1993 | [JP] | Japan | 5-270312 |
| Apr. 14, 1994 | [JP] | Japan | 6-075557 |

[51] Int. Cl.[6] ..... D06F 43/08

[52] U.S. Cl. ..... 68/18 R

[58] Field of Search ..... 68/18 R, 18 C, 68/18 F; 8/142; 210/252, 255, 800, 801

[56] References Cited

U.S. PATENT DOCUMENTS

| | | | |
|---|---|---|---|
| 370,674 | 9/1887 | Bang et al. | 210/255 X |
| 3,577,215 | 5/1971 | Impullitti | 8/142 |
| 4,045,174 | 8/1977 | Fuhring et al. | 8/142 |
| 4,712,392 | 12/1987 | Hagiwara et al. | 68/18 C |
| 4,802,253 | 2/1989 | Hagiwara et al. . | |
| 4,912,793 | 4/1990 | Hagiwara . | |
| 5,056,174 | 10/1991 | Hagiwara | 68/18 R X |

FOREIGN PATENT DOCUMENTS

| | | |
|---|---|---|
| 186621 | 7/1986 | European Pat. Off. . |
| 5309197 | 11/1993 | Japan . |

*Primary Examiner*—Philip R. Coe

*Attorney, Agent, or Firm*—Birch, Stewart, Kolasch & Birch, LLP

[57] ABSTRACT

In a dry cleaner, after clothes 2 is washed, the washing solvent contained in the washed clothes 2 is dissolved into a liquid perfluorocarbon 4*a* being heated at its boiling point or thereabout in order to remove the washing solvent. Thereafter, drying of the clothes 2 is performed by mainly aiming to evaporate the liquid perfluorocarbon 4*a* contained in the clothes 2. Since the drying is targeted on the liquid perfluorocarbon, the time required for drying clothes can markedly reduced.

7 Claims, 8 Drawing Sheets

TEMPERATURE-DEPENDENCE OF SOLUBILITY OF PERFLUOROCARBON INTO HIGH-BOILING POINT COMBUSTIBLE SOLVENT

APPARATUS FOR WASHING AND DRYING CLOTHES

This application is a divisional of application Ser. No. 08/257,295, filed on Jun. 9, 1994, now U.S. Pat. No. 5,498,266 the entire contents of which are hereby incorporated by reference.

FIELD OF THE INVENTION AND RELATED ART STATEMENT

The present invention relates to a method of washing and drying clothes and an apparatus therefor using combustible solvents such as petroleum solvents as a detergent.

With reference to a system diagram shown in FIG. 7, description will be made of a conventional cleaning process by a so-called hot type petroleum dry cleaner which, by itself, can successively perform washing and drying of clothes.

Referring to FIG. 7, clothes 2 are first put in the cleaner through door 1 and then the door 1 is closed. When operation of the cleaner is started, the operation typically proceeds in the following sequence.

(1) A solvent 4 is pumped up from a solvent tank 3 through a valve 5 by a pump 6 so that a necessary amount of solvent 4 is fed into a processing tank 10 through a passage including a valve 7 and a filter 8 or through another passage including a valve 9.

(2) A processing drum 11 is slowly rotated while the solvent 4 is circulated through a circuit including the processing tank 10, a button trap 12, a valve 13, the pump 6, and the valve 7 and the filter 8 or the valve 9, so that clothes 2 are washed.

(3) The solvent 4 is discharged from the processing tank 10 through the button trap 12, the valve 13, the pump 6, the valve 14, a recovery pipe 50 and a distiller 15, and the processing drum 11 then is spun at a high speed to centrifugalize the solvent 4 contained in clothes 2 to be discharged.

(4) The steps (1) and (2) are repeated.

(5) The solvent 4 is discharged from the processing tank 10 through the button trap 12, the valve 13, the valve 5 into the solvent tank 3 and the processing drum 11 then is spun at a high speed to centrifugalize the solvent 4 contained in clothes 2 to be discharged.

(6) The processing drum 11 is slowly rotated again and air is circulated between a recovery air duct 19 including a fan 16, an air cooler 17 and an air heater 18 and the processing tank 10 in the direction of arrow 20 to dry clothes 2. Solvent gas evaporated from clothes.2 is condensed in the air cooler 17 and is fed to a water separator 22 through a recovery passage 21 to be further delivered to a clean tank 24 through a solvent pipe 23.

(7) When drying is completed, dampers 25, 26 are opened as depicted by dotted lines in the drawing to introduce fresh air through the damper 25 while the solvent gas which was not condensed and therefore could not be recovered in the air cooler 17 is exhausted through the damper 26 in order to take away the odor of the solvent contained in the clothes 2.

(8) The solvent 4 which has entered the distiller 15 in the above step (3) is evaporated and is then condensed in a condenser 27. The condensed solvent further proceeds from the condenser 27 through the water separator 22 and the solvent pipe 23 into the clean tank 24 and is then returned to the solvent tank 3 through an overflow partition plate 28.

Water separated by the water separator 22 is discharged outside the system through a water pipe 29.

These are typical processing steps performed in a hot type petroleum dry cleaner. In some systems depending upon manufacturers, it is possible to omit the distiller 15 etc., and fill up the filter portion 8 with a fatty acid adsorbent such as alumina and a decolorant such as activated carbons in order to purify the solvent 4.

Further, in some systems, in order to prevent an explosion in washing and drying steps, the processing tank after clothes 2 have been loaded may be decompressed by an unillustrated vacuum pump and charged with nitrogen gas. Configurations which adopt a distilling system should include advance decompressing system with an unillustrated vacuum pump or the like since a typical petroleum solvent 4 has a relatively high boiling point (170° to 180° C.).

Meanwhile, FIG. 8 is a chart showing a typical washing and drying process when a petroleum solvent is used. As is apparent from the chart, in a typical dry cleaning process, the time required for liquid-discharging and drying steps other than washing accounts for 70% of the total processing time. This is because the liquid-discharging and drying steps require a prolonged time due to the high-boiling point of the solvent used. The lengthiness has been an obstacle to recent demands for shortening the processing time. On the other hand, since prolonged drying might cause damage to clothes, delicate clothes have been previously taken out from the machine after washing and liquid-discharging so as to be wind-dried in the air. This process however, require some hours for drying.

OBJECT AND SUMMARY OF THE INVENTION

Under consideration of the prior art problems described above, it is therefore an object of the present invention to provide a method of washing and drying clothes and an apparatus therefor wherein the time required for the drying step in the conventional dry cleaning process using a high-boiling point combustible solvent, especially petroleum solvent can be reduced and at the same time explosion-proof processing can be achieved. Another object of the present invention is to provide a method of washing and drying clothes wherein the solubility of a petroleum solvent used is further improved in order to avert danger of ignition, explosion and the like.

In accordance with a first aspect of the present invention, a method of washing and drying clothes using a dry cleaner includes the steps of: washing clothes using a high-boiling point combustible solvent such as petroleum solvents and the like; dissolving the solvent contained in the washed clothes into a liquid perfluorocarbon being heated at its boiling point or thereabout in order to remove the solvent; and drying the clothes by mainly aiming to evaporate the liquid perfluorocarbon contained in the clothes. In the present invention, petroleum solvents such as a single component isoparaffin highly soluble in the liquid perfluorocarbon is preferably used as a petroleum solvent.

In another aspect of the present invention, a dry cleaner for washing and drying clothes with a high-boiling point combustible solvent such as petroleum solvents and the like, includes: a first solvent reserve tank for containing a high-boiling point combustible solvent; a second solvent reserve tank for containing a liquid perfluorocarbon; a processing tank for washing clothes with solvents reserved in the solvent reserve tanks; a means for separating and recovering each solvent used for washing after completion of washing of clothes in the processing tank; and a means for drying clothes in the processing tank.

In accordance with a further aspect of the present invention, a method of washing and drying clothes using a dry cleaner with a high-boiling point combustible solvent such as petroleum solvents and the like, includes the steps of:

washing clothes preferably in a mixture of a liquid perfluorocarbon and a high-boiling point combustible solvent such as petroleum solvents and the like; discharging most part of the liquid mixture contained in the washed clothes;

dissolving the liquid mixture still remaining in the clothes into the liquid perfluorocarbon being heated at its boiling point or thereabout in order to remove the solvent; and drying the clothes by mainly aiming to evaporate the liquid perfluorocarbon contained in the clothes. Further, in this method, it is preferable that the temperature of the liquid mixture of the liquid perfluorocarbon and the high-boiling point combustible solvent is elevated to a flash point or thereabout of the high-boiling point combustible solvent.

In the present invention, in the case where a mixture of the liquid perfluorocarbon and the high-boiling point combustible solvent as a petroleum solvent is used, it is possible to remarkably enhance the detergency of the petroleum solvent by heating the liquid perfluorocarbon having a relatively low boiling point and the high-boiling point combustible solvent to a temperature at about the flash point of the high-boiling point combustible solvent using, for example a heating means and providing the heated mixture to the dry cleaner. Further, the inertness and non-inflammable performance of the liquid perfluorocarbon-coexisting can heighten the apparent flash point of the petroleum solvent (about 30 degrees) to present an excellent effect.

Further, after washing, in order to promote the dissolution and removal of the high-boiling solvent, the liquid perfluorocarbon is heated to approximately 40° C. to 80° C. by the aforementioned heating means and supplied to the processing tank while the thus supplied perfluorocarbon is kept at a required temperature by, for example, a heating means disposed in the processing tank. In order to recycle the solvents, the liquid perfluorocarbon having a temperature of approximately 40° C. to 80° C. and containing the high-boiling point combustible solvent dissolved therein is cooled down below normal temperature so that the high-boiling point solvent is separated taking advantage of solubility difference of the solvent depending upon temperatures and specific gravity difference between the two material.

By providing a function of fractionating the liquid mixture of the high-boiling point solvent and the low-boiling point solvent for recycling; a function of decompressing the inside of the processing tank before washing, alternatively, a pressure-absorbing function for compensating the rise of an internal pressure of the processing tank; and a function of releasing the internal pressure of the tank by way of an activated carbon solvent recovery device; and the like, prevention of abnormal increase of pressure inside the processing tank is effected. Further, by these functions, the solvent gas is pumped utilizing the pressure increase.

In this way, after clothes are washed with a high-boiling point combustible solvent, the high-boiling point combustible solvent is dissolved and removed from the clothes utilizing the temperature-dependence of the solubility of the high-boiling point combustible solvent in the liquid perfluorocarbon. In drying, drying of clothes are effected by aiming mainly to evaporate the perfluorocarbon that has a low boiling point. Thus, non-combustibility and inertness of the liquid perfluorocarbon provides explosion resistance, so that it is possible to achieve essential objects, that is, to safely enhance the detergency as well as to remarkably shorten the drying time.

Moreover, in the case where the liquid perfluorocarbon having a low boiling point and inertness is heated to be used in combination in both washing and drying stages, the above- mentioned effects are further enhanced.

On the other hand, the high-boiling point combustible solvent removed from the clothes and dissolved in the liquid perfluorocarbon can be separately recovered by a separating means utilizing the solubility difference depending upon temperature and the specific gravity difference so that the solvents may be recycled. By the decompressing function before washing, or the pressure-absorbing function or the pressure-releasing function, it is possible to inhibit the pressure increase of evaporation of the liquid perfluorocarbon when the liquid enters at approximately 40° C. to 80° C. Besides, an appropriate pressure increase is effectively used for pumping operation.

To sum up, according to the present invention, after washing, the high-boiling point combustible solvent contained in clothes is replaced with the liquid perfluorocarbon heated at approximately 40° C. to 80° C. This makes it possible to completely discharge the high-boiling point solvent as well as to remarkably reduce the time required for drying clothes. Further, the non-combustibility and inertness of liquid perfluorocarbon may provide excellent effects such as to establish explosion proof processing.

DESCRIPTION OF THE PREFERRED EMBODIMENTS

Embodiments of the present invention will hereinafter be described with reference to the accompanying drawings.

Figure 1:
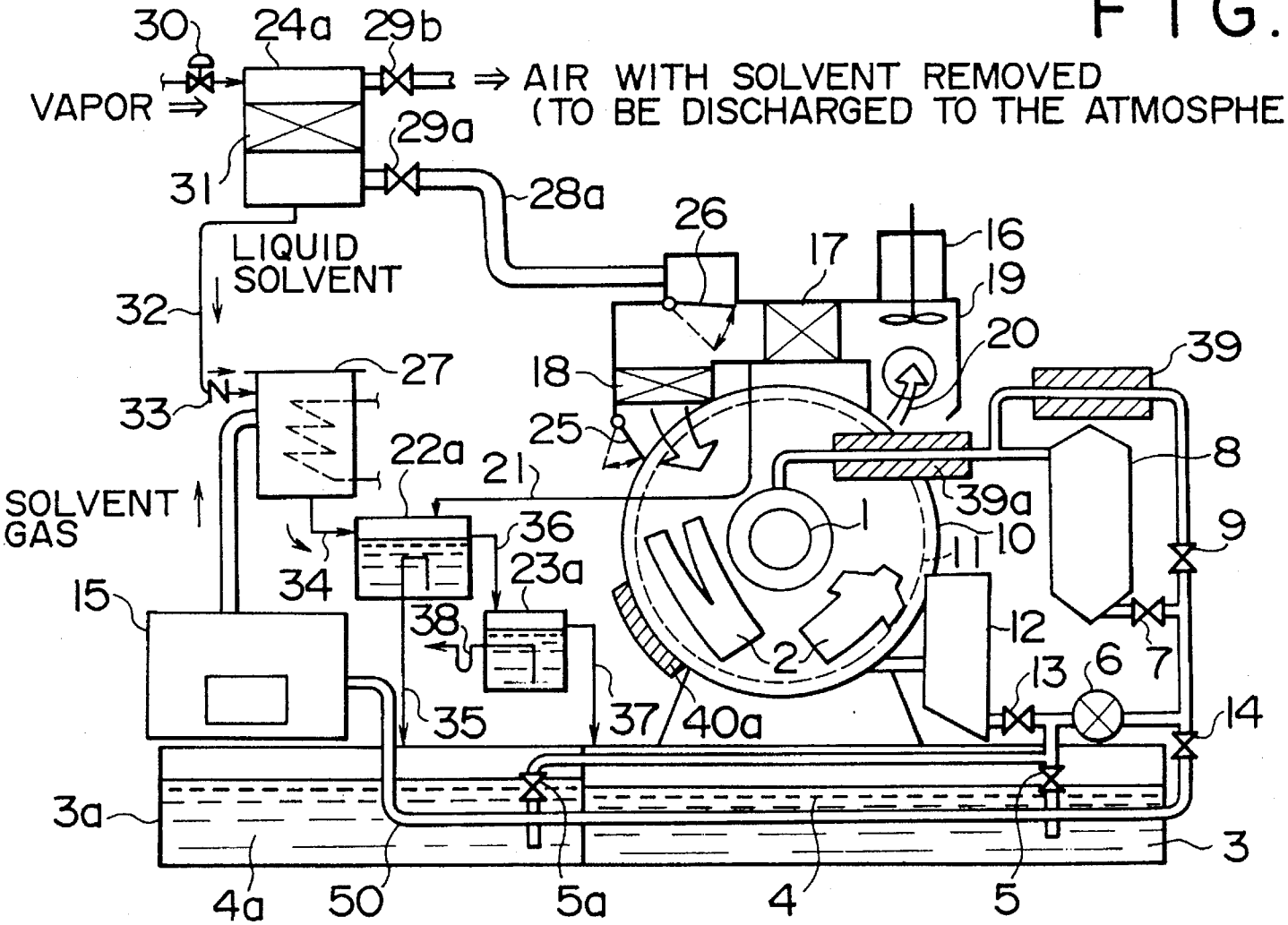
FIG. 1 is a system diagram showing an overall configuration of a dry cleaner in accordance with a first embodiment of the present invention.
Figure 7:
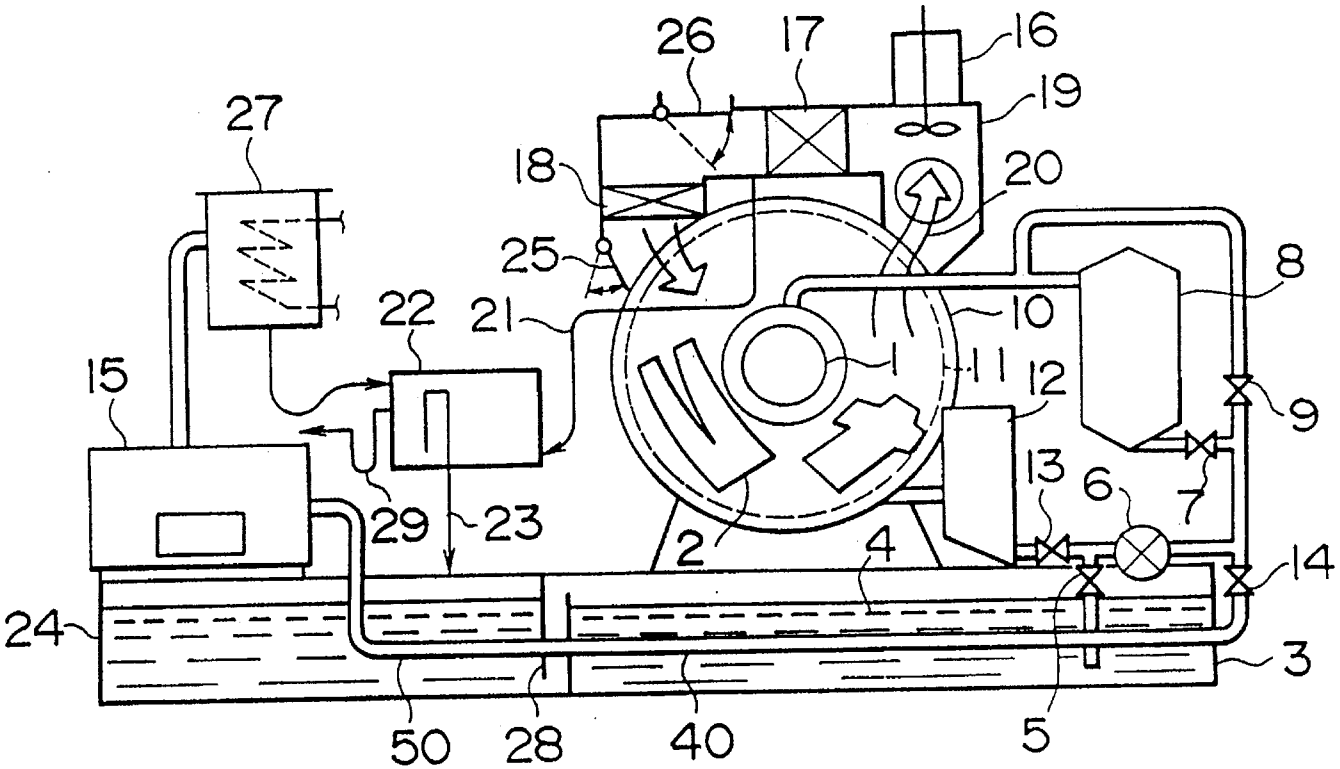
PRIOR ART FIG. 7
FIG. 7 is a system diagram showing a prior art dry cleaner.
Figure 8:
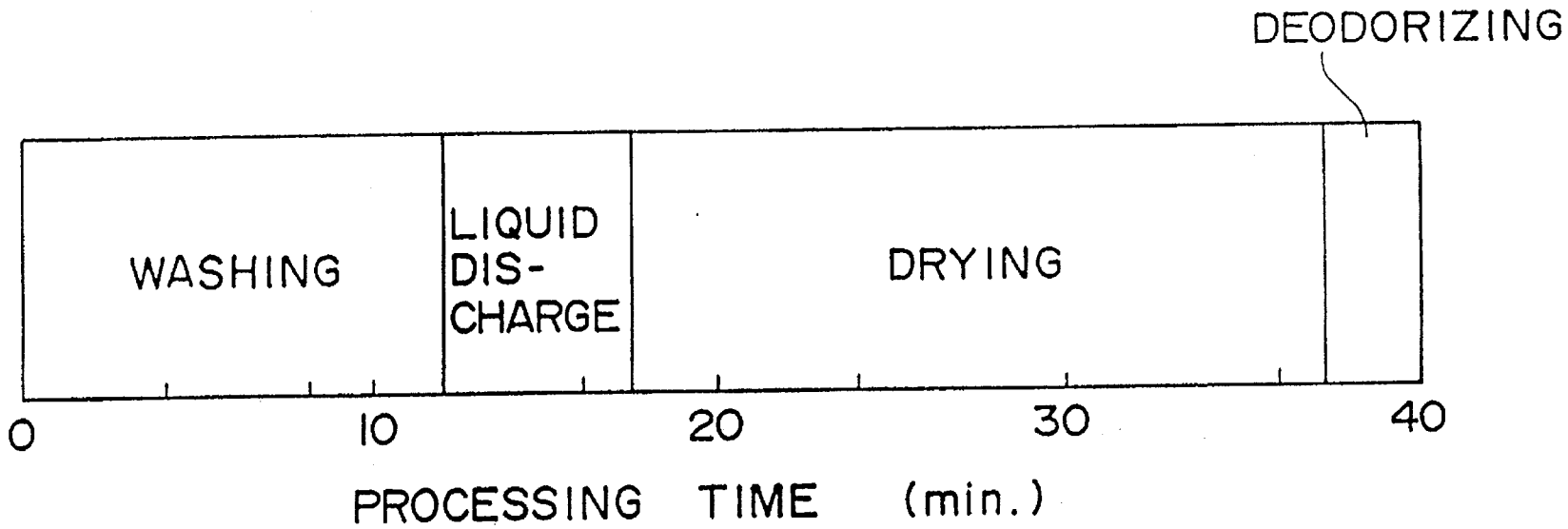
PRIOR ART FIG. 8
FIG. 8 is a process-chart showing washing and drying steps in a typical drying cleaner using a petroleum solvent.

FIG. 1 shows a dry cleaner of a first embodiment in accordance with the present invention. The dry cleaner shown in FIG. 1 differs from the prior art dry cleaner shown in FIG. 7 mainly in the following features. That is, the first embodiment has individual first and second solvent reserve tanks 3 and 3*a* for containing first and second solvents, respectively. The reserve tanks 3 and 3*a* are equipped with dedicated valves 5 and 5*a*, respectively while the prior art dry cleaner shown in FIG. 7 has an integrated solvent reserve tank 3. In place of the water separator 22 provided in the prior art cleaner shown in FIG. 7, the cleaner of the first embodiment has a series of first and second solvent separators 22*a* and 23*a* and further is provided with an activated carbon solvent recovery device 24*a* through a duct 28*a*. These are the main differences, and the other elements are substantially similar to those in the prior art example shown in FIG. 7, therefore the detailed description of the similar elements will be omitted.

Referring now to FIG. 1 the operation of the thus constructed embodiment will be described. In FIG. 1, assuming that the first solvent is a high-boiling point combustible solvent and the second solvent is liquid perfluorocarbon, the high-boiling point combustible solvent 4 is replaced with liquid perfluorocarbon 4*a* in the course of washing. The procedure of the replacement will be explained hereinafter. Here, although heating devices 39 and 39*a* are shown in FIG. 1, this embodiment is provided only with the heating device 39.

(1) The high-boiling point combustible solvent 4 is pumped up from the tank 3 through the valve 5 by the pump 6 so that a necessary amount of the solvent 4 is fed into the processing tank 10 through a passage including the valve 7 and the filter 8 or through another passage including the valve 9.

(2) The processing drum 11 is slowly rotated while the high-boiling point combustible solvent 4 is circulated through a circuit including the processing tank 10, the button trap 12, the valve 13, the pump 6, and the valve 7 and the filter 8 or the valve 9, so that clothes 2 are washed.

(3) The high-boiling point combustible solvent 4 is discharged from the processing tank 10 through the button trap 12, the valve 13, the pump 6, the valve 14 and the distiller 15, and the processing drum 11 then is spun at a high speed to centrifugalize the high-boiling point combustible solvent 4 contained in clothes 2 to be discharged.

(4) The liquid perfluorocarbon 4*a* is pumped up from the tank 3*a* through the valve 5*a* by the pump 6 so that a necessary amount of the liquid perfluorocarbon 4*a* is heated to a necessary temperature through the valve 9 and the heating device 39 and then fed to the processing tank 10.

(5) The same operation shown in step (2) is performed except in that the high-boiling point combustible solvent 4 is replaced with the liquid perfluorocarbon 4*a*. Here, the perfluorocarbon 4*a* in the processing tank 10 is kept at the necessary temperature by means of the heating device 39.

(6) The liquid perfluorocarbon 4*a* having high-boiling point combustible solvent 4 dissolved therein is discharged from the processing tank 10 through the button trap 12, the valve 13, the pump 6, the valve 14 and the distiller 15. Subsequently, the processing drum 11 then is spun at a high speed so as to centrifugalize the mixed solvent (that is, the liquid perfluorocarbon 4*a* having high-boiling point combustible solvent 4 dissolved therein) contained in clothes 2 to be discharged.

(7) Again, the processing drum 11 is slowly rotated and air is circulated between the recovery air duct 19 including the fan 16, the air cooler 17 and the air heater 18 and the processing tank 10 in the direction of arrow 20 to dry clothes 2. The solvent gas mainly consisting of perfluorocarbon evaporated from clothes 2 is condensed in the air cooler 17 and flows into the first solvent separator 22*a* through the recovery passage 21.

(8) When drying is completed, dampers 25, 26 are opened as depicted by dotted lines in the drawing to introduce fresh air through the damper 25 while the solvent gas which was not condensed and therefore could not be recovered in the air cooler 17 is exhausted through the damper 26 in order to take away the odor of the solvent contained in the clothes 2.

(9) The uncondensed solvent gas discharged from the damper 26, passing through the duct 28*a* and a valve 29*a*, is fed to the activated carbon solvent recovery device 24*a* including an activated carbon layer 31. The thus introduced solvent gas is adsorbed and collected by the activated carbon layer 31 while the air from which the solvent component has been removed is exhausted through the valve 29*b* to the atmosphere.

(10) The high-boiling point combustible solvent 4 and liquid perfluorocarbon 4*a* fed to the distiller 15 in the above steps (3) and (6) is evaporated in the distiller 15 and then condensed and collected in the condenser 27. Then, liquid perfluorocarbon 4*a* is gravity-separated from a mixture of water and high-boiling point combustible solvent 4 in the first solvent separator 22*a*. The thus separated liquid perfluorocarbon 4*a*, passing through a recovery pipe 35, is recovered in the second solvent reserve tank 3*a*. Next, the mixture of water and high-boiling point combustible solvent 4 flows through a discharging pipe 36 into the second solvent separator 23*a*, in which high-boiling point combustible solvent 4 is gravity-separated from the water. The thus separated high-boiling point combustible solvent 4 passes through a recovery pipe 37 to be recovered in the first solvent reserve tank 3.

Here, the water separated by the second solvent separator 23*a* is discharged outside the system through a water drain pipe 38.

(11) The solvent component adsorbed in the above step (9) by the activated carbon layer 31 in the activated carbon solvent recovery device 24a is displaced by steam that is introduced through a valve 30. The thus separated solvent component flows through a pipe 32 and a check valve 33 into the condenser 27 so that the component is condensed and recovered.

(12) After the deodorizing stage in the above steps (8) and (9) has been over, the door 1 is opened so that clothes 2 are taken out. Thus, an entire sequence of dry cleaning is completed.

Although no reference has been made in the description of the above process, the liquid perfluorocarbon 4*a* heated in the step (4) partly evaporates when it flows into the processing tank 10. To deal with this, drying operation as in the step (7) may be performed as required in order to condense and recover the vapor. In addition, rise in the pressure inside the processing tank 10 may be relieved by way of the activated carbon solvent recovery device 24*a* by opening the damper 26 in cooperation with the drying.

In order to further prevent the internal pressure of the processing tank 10 from rising, it is also possible to perform, after clothes 2 are charged into the processing tank 10, a so-called decompressing step in which a necessary amount of the air inside the processing tank 10 is removed in advance by an unillustrated vacuum generator.

Alternatively, it is also possible to provide an unillustrated bag-like pressure compensator which is directly connected to the processing tank 10. This compensator is adapted to temporally absorb the pressure inside the processing tank 10 and release the pressure inside the bag, for example, during the deodorizing stage performed in steps (8) and (9).

Further, in the distillation in the step (10), the inside of the distiller 15 is generally decompressed in advance by an unillustrated vacuum generator.

Thus, in this embodiment, the drying time of clothes can markedly be reduced by replacing the high-boiling point combustible solvent with the liquid perfluorocarbon having a low boiling point after the washing stage.

Next, a second embodiment in accordance with the present invention will be described by mainly referring to different features from the first embodiment.

Figure 2:
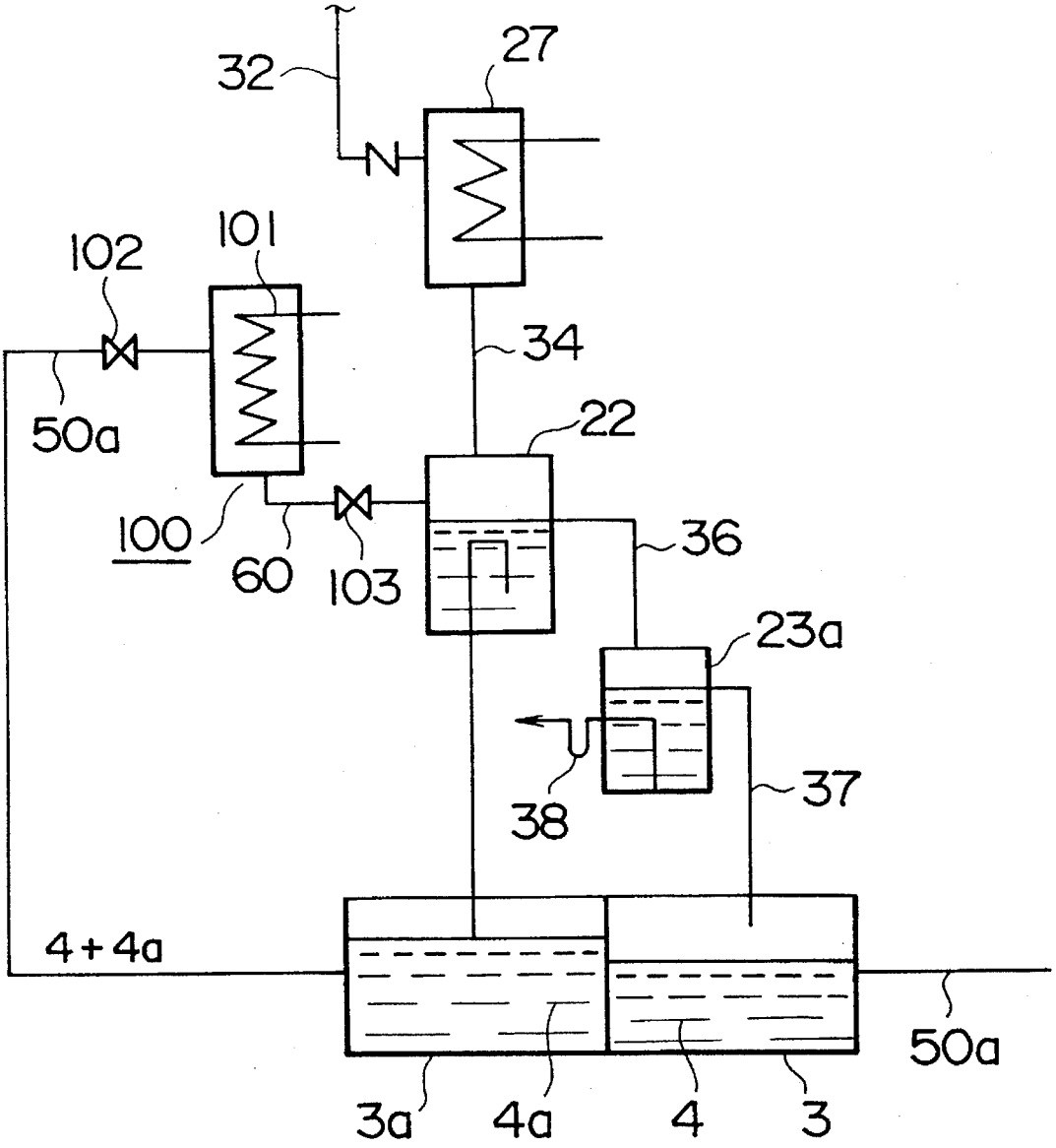
FIG. 2 is a system diagram showing a part of a dry cleaner in accordance with a second embodiment of the present invention.

FIG. 2 shows a configuration in which the distiller 15 described in the step (6) of the first embodiment is replaced by a separation recovering device 100. The separation recovering device 100 can separate and recover the high-boiling point combustible solvent 4 (dissolved in liquid perfluorocarbon 4*a*) from the mixture of liquid perfluorocarbon 4*a* (to be discharged) and high-boiling point combustible solvent 4 without performing distillation by making use of the solubility difference of the high-boiling point solvent 4 in the liquid perfluorocarbon 4*a* between different temperatures. The separation recovering device 100 comprises, as shown in FIG. 2, a cooling coil 101 for cooling liquid perfluorocarbon 4, an input valve 102 and an output valve 103. In this arrangement, the liquid perfluorocarbon 4*a* having the high-boiling combustible point solvent 4 dissolved therein is delivered through a recovery pipe 50*a* and the input valve 102 into the separation recovering device 100, in which the introduced liquid perfluorocarbon 4*a* containing the high-boiling combustible point solvent 4 having a temperature of approximately 40° C. to 80° C. is cooled down by the cooling coil 101.

Figure 3:
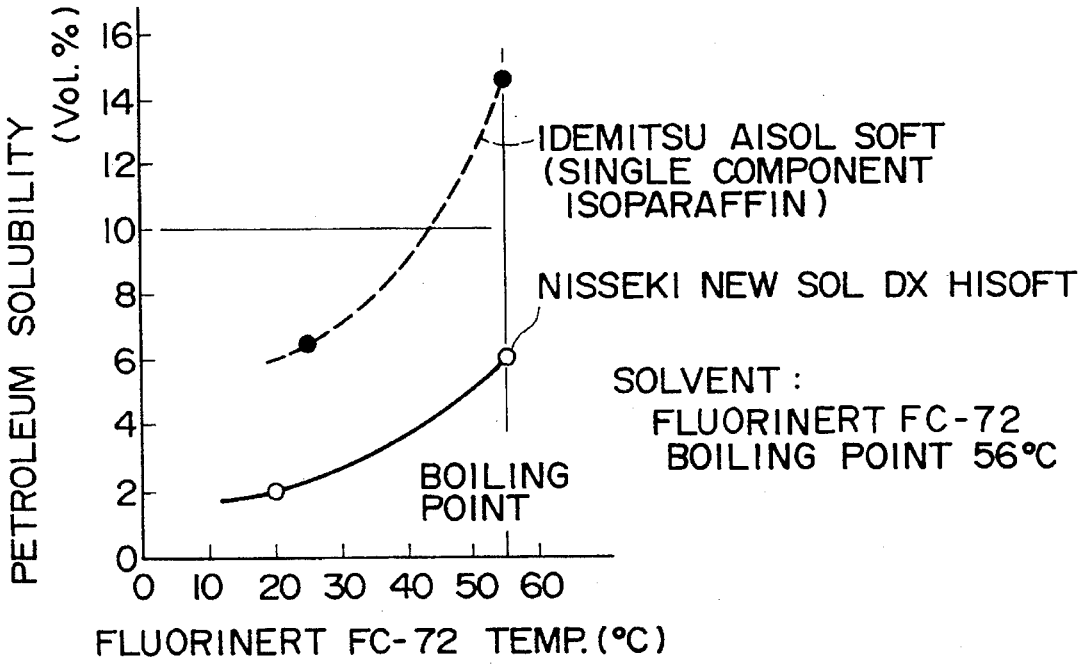
FIG. 3 is a graph showing temperature-dependence of solubility of high-boiling point combustible solvents in perfluorocarbon.

FIG. 3 represents a graph showing temperature-dependence of solubility of high-boiling point combustible solvents in the liquid perfluorocarbon 4*a* where the liquid perfluorocarbon 4*a* uses FLUORINERT FC-72 and the high-boiling point combustible 4 uses NISSEKI New Sol DX Hisoft (a product of NIPPON OIL COMPANY, LTD.) as a three component (i.e., paraffin, naphthene and aromatic) petroleum solvent and IDEMITSU AISOL SOFT (a product of IDEMITSU KOSAN CO., LTD.) as an isoparaffin single component petroleum solvent. As will be understood from the graph, the ratio of the solvent dissolved in the liquid perfluorocarbon reduces as the temperature is lowered. The isoparaffin single component solvent, in particular, has a high solubility at high temperatures. On the basis of the characteristics, the high-boiling point combustible solvent 4 is separated from the liquid perfluorocarbon 4*a* and floats upward due to difference of specific gravity.

After the liquid temperature inside the separation recovering device 100 has lowered down to a predetermined level, the total amount of the liquid is fed through a delivery pipe 60 and the outlet valve 103 to, for example, the first solvent separator 22*a*. Upon the movement of the liquid, the liquid having two layers separated inside the separation recovery device 100 is introduced to the first solvent separator 22*a* with little disturbing the separated state and subsequently the liquid having a smaller specific gravity is separately introduced to the second solvent separator 23*a*.

In sum, according to the system of the embodiment, liquid perfluorocarbon 4*a* can be separated in principle without effecting distillation. This significantly contributes to saving energy for distillation.

Figure 6:
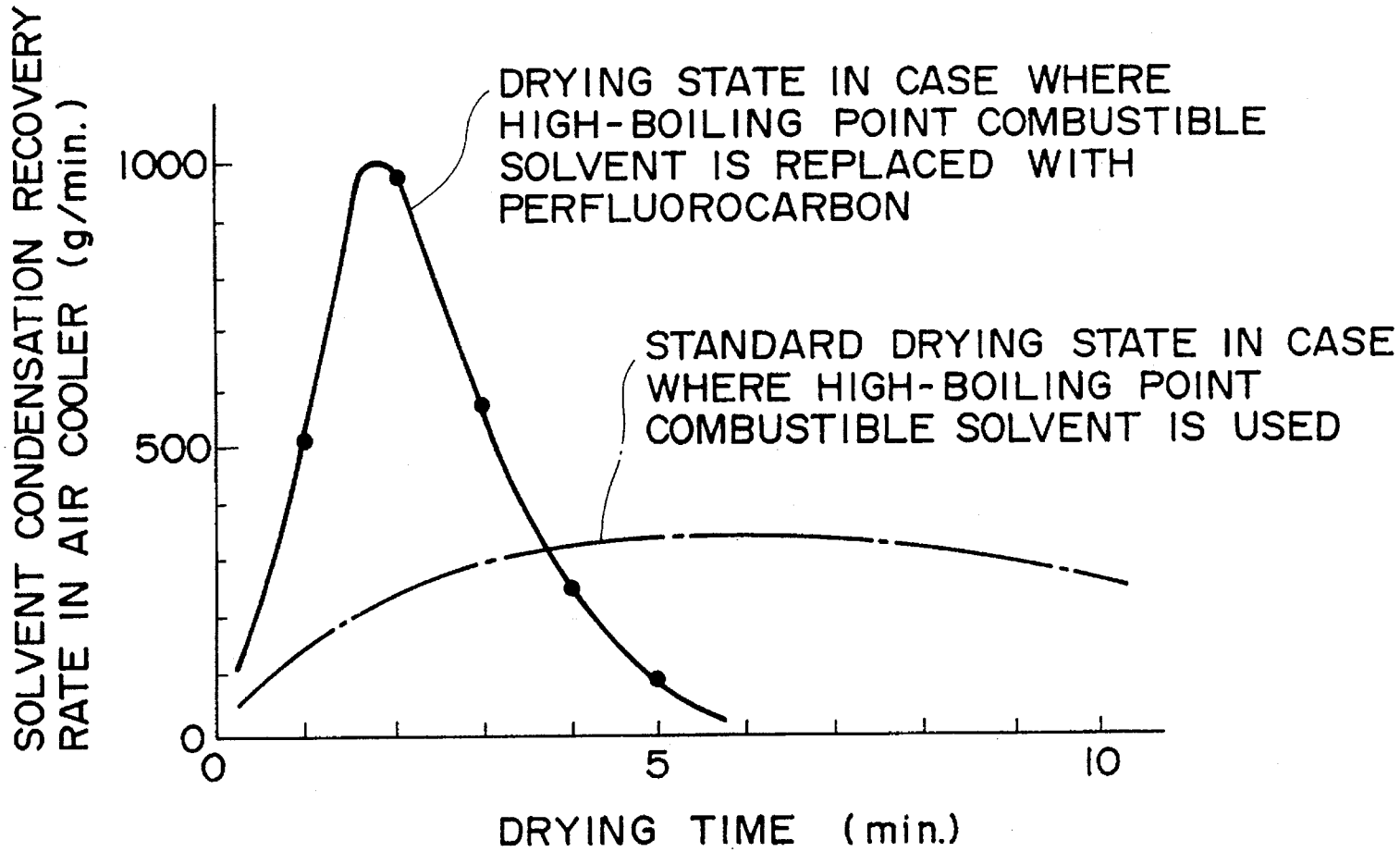
FIG. 6 is a plot showing a relation between the drying time and the solvent condensation recovery rate in an air cooler in accordance with a method of the present invention, in comparison with that of the prior art method.

As the foregoing part has been allotted for the description of the embodiments of the present invention, now, FIG. 6 shows a graph representing a comparison of drying times of clothes between the present invention and the prior art, and examples of the liquid perfluorocarbon to be used in the present invention are shown in Table 1.

Here, FIG. 6 shows a result of a solvent condensation recovery curve obtained in a case where 10kg clothes such as wool knit, etc. were washed and dried using a petroleum solvent, IDEMITSU AISOL SOFT (boiling point: 170° C. to 200° C.) as a high-boiling point combustible solvent and a liquid perfluorocarbon (trade name: FLUORINERT FC-72) having a boiling point of 56° C. as a low boiling point solvent. In the figure, a comparative result is also shown which was obtained when a washing and drying was performed using a usual petroleum solvent. As is apparent from FIG. 6, the method of the present invention makes it possible to markedly reduce the drying time as compared to the prior art method. It should be added that a similar result has been obtained when NISSEKI New Sol DX Hisoft was used as a high-boiling point combustible solvent.

TABLE 1

Liquid perfluorocarbons to be used for the present invention and their property

| Liquid Perfluoro-carbon (Trade Name) | Surface Tension (dyne/cm) | Boiling Point (°C.) | Latent Heat of Evaporation (kcal/kg) | Density (g/cm$^3$) | Dissolved Amount of Water (wt. ppm) |
|---|---|---|---|---|---|
| FLUORINERT FC-72 | 12 | 56 | 21 | 1.68 | 10 |
| FLUORINERT FC-84 | 13 | 80 | 19 | 1.73 | 11 |
| FLUORINERT FC-77 | 15 | 97 | 20 | 1.78 | 13 |
| FLUORINERT FC-75 | 15 | 102 | 21 | 1.77 | 11 |
| F-LEAD KPF-61 | 11.9 | 58 | 19.8 | 1.72 | Unknown |
| F-LEAD KPF-72 | 15.4 | 76 | 20.5 | 1.79 | Unknown |
| F-LEAD KPF-82 | 16.6 | 102 | 19.8 | 1.83 | Unknown |

Next, a third embodiment of the present invention will be described with reference to FIG. 1. This embodiment is basically similar to that in the first embodiment but differs therefrom in that a high-boiling point combustible solvent is mixed with a liquid perfluorocarbon and a heating device 39*a* is used in place of the heating device 39.

(1) The liquid perfluorocarbon 4*a* from the tank 3 and subsequently the high-boiling point combustible Solvent 4 from the tank 3*a* are pumped up through the valve 5 by the pump 6, so that a necessary amount of the solvent mixture is heated to a necessary temperature through the valve 7, the valve 9 and the heating device 39*a* and then fed to the processing tank 10.

(2) The processing drum 11 is slowly rotated while the solvent mixture (4+4*a*) of the high-boiling point combustible solvent 4 and the liquid perfluorocarbon 4*a* is circulated through a circuit including the processing tank 10, the button trap 12, the valve 13, the pump 6, and the valve 7 and the filter 8 or the valve 9 and the heating device 39*a*, so that clothes 2 are washed.

(3) The solvent mixture (4+4*a*) is discharged from the processing tank 10 through the button trap 12, the valve 13, the pump 6, the valve 14 and the distiller 15, and the processing drum 11 then is spun at a high speed to centrifugalize the solvent mixture (4+4*a*) contained in clothes 2 to be discharged.

(4) The liquid perfluorocarbon 4*a* is pumped up from the tank 3*a* through the valve 5*a* by the pump 6 so that a necessary amount of the liquid perfluorocarbon 4*a* is heated to a necessary temperature through the valve 9 and the heating device 39*a* and then fed to the processing tank 10.

(5) The same operation shown in step (2) is performed except in that the solvent mixture (4+4*a*) is assumed as the liquid perfluorocarbon 4*a*. Here, the perfluorocarbon 4*a* in the processing tank 10 is kept at the necessary temperature by means of the heating device 39*a*.

Hereinafter, steps (6) to (12) are the same with those in the above first embodiment so that the description as to the first embodiment can be applied as it is in this case. Further, the similar modification to that in the second embodiment can also be made.

Figure 4:
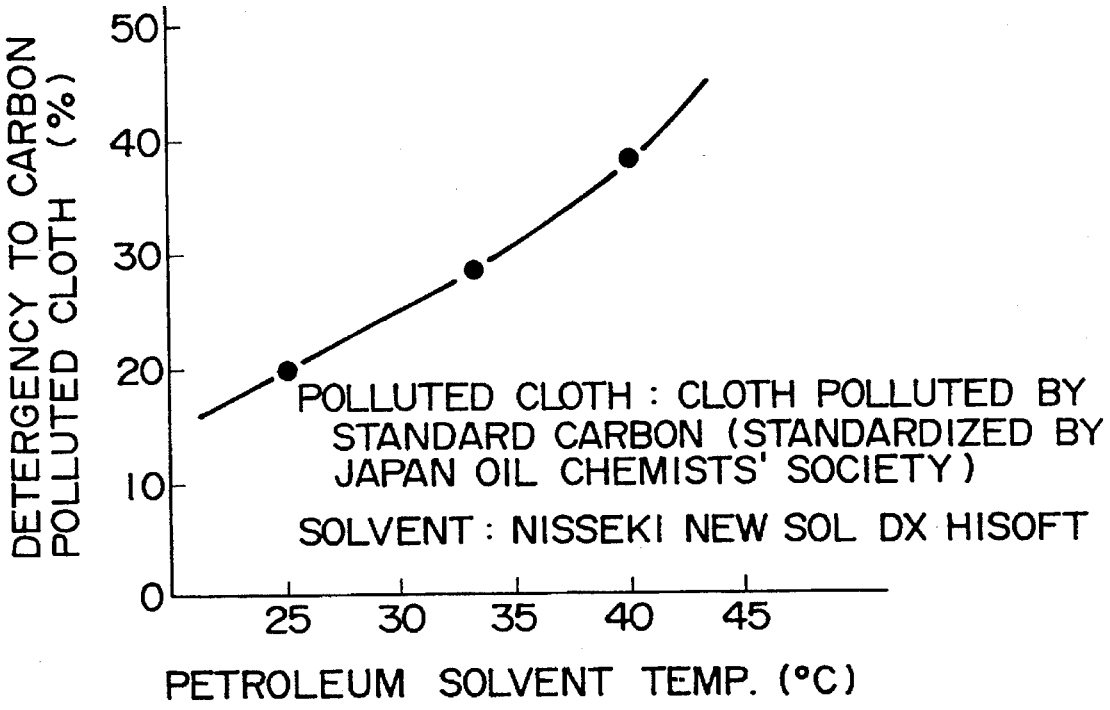
FIG. 4 is a graph for showing temperature-dependence of detergency of a petroleum solvent.

FIG. 4 shows a test example in which detergency was evaluated using a cloth polluted by standard carbon (defined by Japan Oil Chemists' society). It is apparent from FIG. 4 that the petroleum solvent at a higher temperature of 40° C. exhibits about two times as strong a detergency as that at 25° C. (normal using temperature). Therefore, it is expected that the use of the mixed solvent can improve the detergency.

Figure 5:
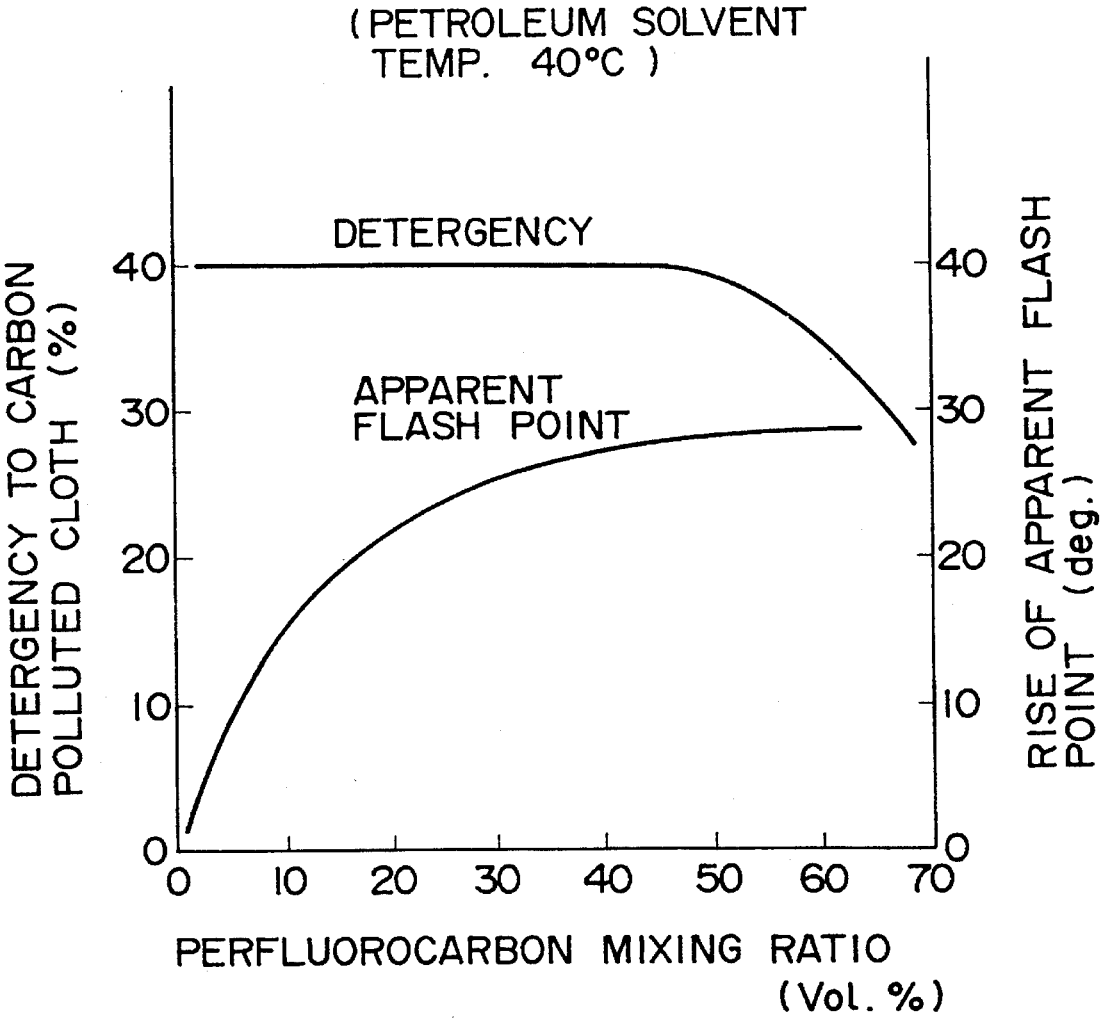
FIG. 5 is characteristic chart showing the behavior of detergency and the rise of flash point in dependence with a mixing ratio of perfluorocarbon when the petroleum solvent temperature is 40° C.

FIG. 5 shows rise of the apparent flash point as the mixing proportion of a perfluorocarbon increases.

Thus, in accordance with the third embodiment, mixing of a high-boiling point combustible solvent and a liquid perfluorocarbon enables the washing of clothes to be effected at the vicinity of a flash point of the high-boiling point solvent (30° C. to 50° C. for petroleum solvents) or at temperatures elevated by mixing effect. Therefore, the apparent flash point of the liquid perfluorocarbon is raised by the mixing effect, so that it is possible to bring out the best detergent effect safely.

In this embodiment as stated above, although description has been made as to the case in which the mixture of a high-boiling point combustible solvent and a liquid perfluorocarbon is heated at 30° to 50° C., it is needless to say that the washing process can be effected with the solvent mixture being at normal temperature or at a lower temperature, e.g. at 10° C. or thereabout as required if the washes are made of delicate material and therefore subject to be affected by the solvent (for example, to be modified by dissolution).

What is claimed is:

1. A dry-cleaning apparatus for washing and drying clothes with a high boiling point combustible solvent comprising:

a first solvent reserve tank for containing a high boiling point combustible solvent;

a second solvent reserve tank for containing a liquid perfluorocarbon;

a processing tank for washing clothes, selectively connected with solvents reserved in said first and second solvent reserve tanks;

liquid separator means for separating and recovering each solvent used for washing after completion of washing of clothes in said processing tank; and a means for drying clothes in said processing tank.

2. The dry-cleaning apparatus according to claim 1, wherein said means for separating and recovering each solvent are specific gravity liquid separators.

3. The dry-cleaning apparatus according to claim 2, wherein said specific gravity liquid separators are connected in series, such that a lower specific gravity liquid from a first liquid separator is passed into a second liquid separator.

4. The dry-cleaning apparatus according to claim 3, wherein said first liquid separator separates said high-boiling point combustible solvent from said liquid perfluorocarbon and said second liquid separator separates said high-boiling point combustible solvent from any water-contamination derived from the washing process.

5. The dry-cleaning apparatus according to claim 1, further comprising at least one liquid solvent heating means for heating liquid solvents entering said processing tank.

6. The dry-cleaning apparatus according to claim 5, further comprising solvent cooling means connected upstream said solvent separator and recovery means, to effect cooling of said solvents.

7. A dry-cleaning apparatus for washing and drying clothes with a high-boiling point combustible solvent, comprising:

first and second solvent reserve tanks for containing a first high-boiling point combustible solvent and a second liquid perfluorocarbon solvent, respectively;

liquid solvent heating means for heating said first and/or second solvents;

a processing tank for washing clothes, selectively connected to either or both of said first and second solvent reserve tanks through said solvent heating means; and a solvent separation and recovery system consisting essentially of solvent cooling means and a series of specific gravity liquid separators, for cooling mixtures of said first and second solvents so as to effect separation of said solvents based on their differing specific gravities.

* * * * *